US008714170B1

(12) United States Patent
Bonne et al.

(10) Patent No.: US 8,714,170 B1
(45) Date of Patent: May 6, 2014

(54) MOBILITY ASSISTANCE RETRIEVAL SYSTEM

(76) Inventors: William K. Bonne, Milwaukee, WI (US); Erin M. Bonne, Milwaukee, WI (US)

( * ) Notice: Subject to any disclaimer, the term of this patent is extended or adjusted under 35 U.S.C. 154(b) by 0 days.

(21) Appl. No.: 13/560,633

(22) Filed: Jul. 27, 2012

(51) Int. Cl.
*A45B 3/00* (2006.01)
*A61H 3/02* (2006.01)

(52) U.S. Cl.
CPC .. *A45B 3/00* (2013.01); *A61H 3/02* (2013.01); *A61H 2003/0222* (2013.01)
USPC ..... 135/66; 135/67; 135/72; 135/84; 294/104

(58) Field of Classification Search
CPC ..... A45B 3/00; A45B 9/02; A61H 3/02; A61H 2003/0222; A63C 2203/20
USPC ..... 135/65–67, 72, 77, 80, 84; 248/155, 248/218.4, 219.3, 227.3, 228.6; 294/19.1, 294/104
See application file for complete search history.

(56) References Cited

U.S. PATENT DOCUMENTS

| | | | | | |
|---|---|---|---|---|---|
| 3,763,872 | A | | 10/1973 | Gooley | |
| 4,300,742 | A | * | 11/1981 | Hunn | 248/689 |
| 4,748,994 | A | * | 6/1988 | Schultz et al. | 135/67 |
| 5,176,160 | A | * | 1/1993 | Osborn | 135/66 |
| 5,192,104 | A | * | 3/1993 | Lin | 294/104 |
| 5,277,391 | A | * | 1/1994 | Haug et al. | 248/219.3 |
| 5,392,800 | A | | 2/1995 | Sergi | |
| 5,433,234 | A | | 7/1995 | Lapere | |
| 5,636,650 | A | * | 6/1997 | Kroeze | 135/66 |
| 5,640,985 | A | * | 6/1997 | Snyder et al. | 135/65 |
| 6,550,490 | B1 | * | 4/2003 | Morton et al. | 135/66 |
| 6,951,224 | B2 | | 10/2005 | Garrett | |
| 7,243,668 | B1 | * | 7/2007 | Kroeze | 135/77 |
| D620,696 | S | | 8/2010 | Alacar, Jr. et al. | |
| 2009/0032077 | A1 | | 2/2009 | Hines | |

FOREIGN PATENT DOCUMENTS

| | | | | | |
|---|---|---|---|---|---|
| GB | 2209934 | A | * | 6/1989 | A45B 3/00 |
| GB | 2365333 | A | * | 2/2002 | A45B 3/00 |

* cited by examiner

*Primary Examiner* — Winnie Yip

(57) ABSTRACT

A mobility assistance retrieval system to help users grab objects out of reach featuring a cane, walker, or scooter, a grabber, and one or more clips for attaching the grabber to a leg shaft of the cane, walker, or scooter. The user can unclip the grabber from the cane, walker, or scooter and obtain an object without having to reach or bend for the object.

10 Claims, 3 Drawing Sheets

MOBILITY ASSISTANCE RETRIEVAL SYSTEM

BACKGROUND OF THE INVENTION

Many individuals who use walkers or canes may wish to pick up an item, for example an that has fallen on the floor or an item that is not within reach. In some instances, such individuals may put aside the cane or walker and subsequently bend or reach to retrieve the item. The present invention features a mobility assistance retrieval system. The system of the present invention provides a cane or walker user with a means of reaching for an object without having to put aside his/her cane or walker.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
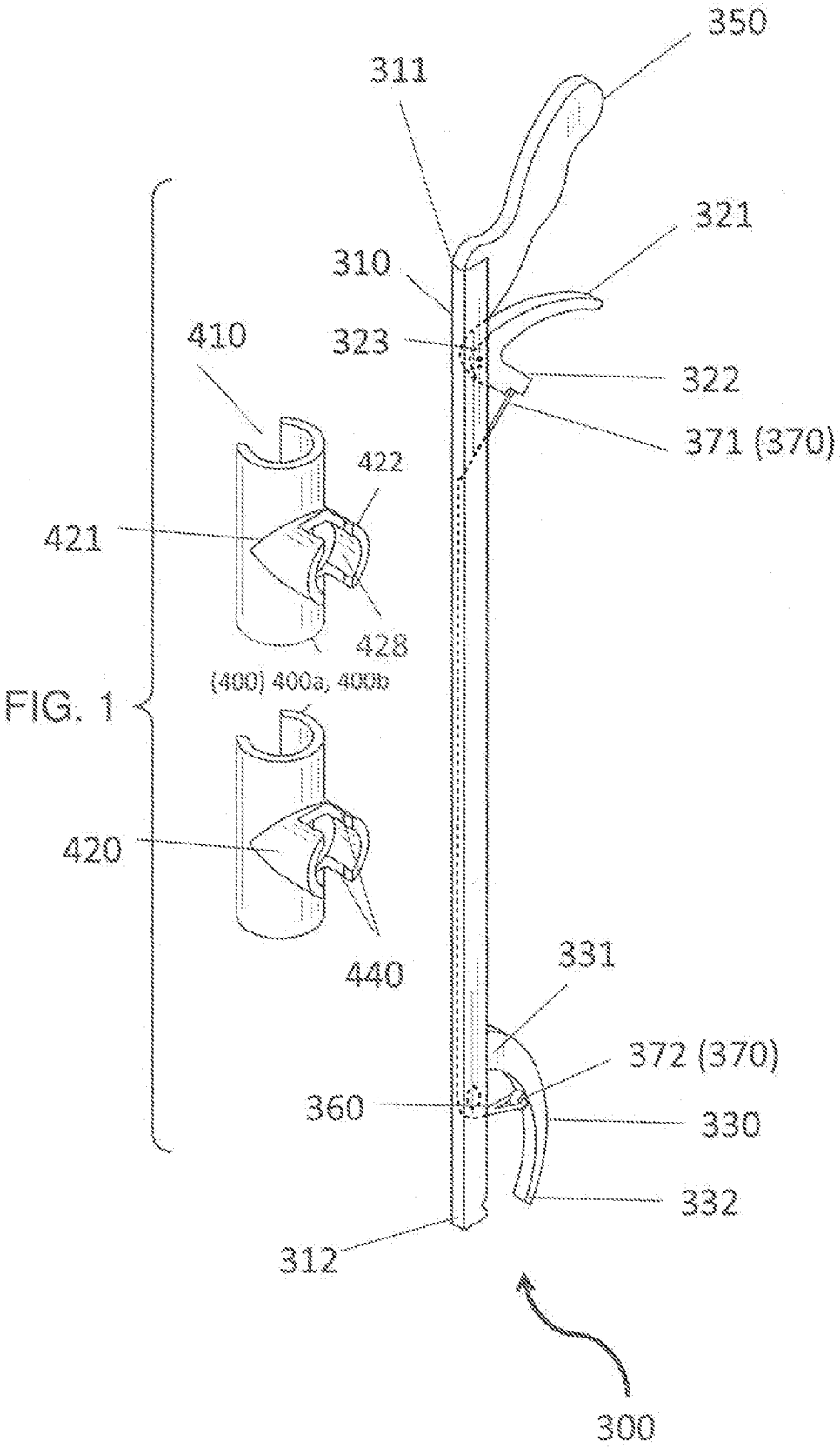
FIG. 1 is a detailed view of the system of the present invention.
Figure 2:
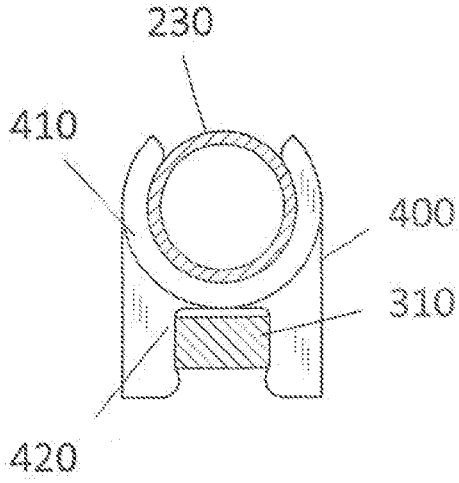
FIG. 2 is a top view of the system of the present invention.
Figure 3:
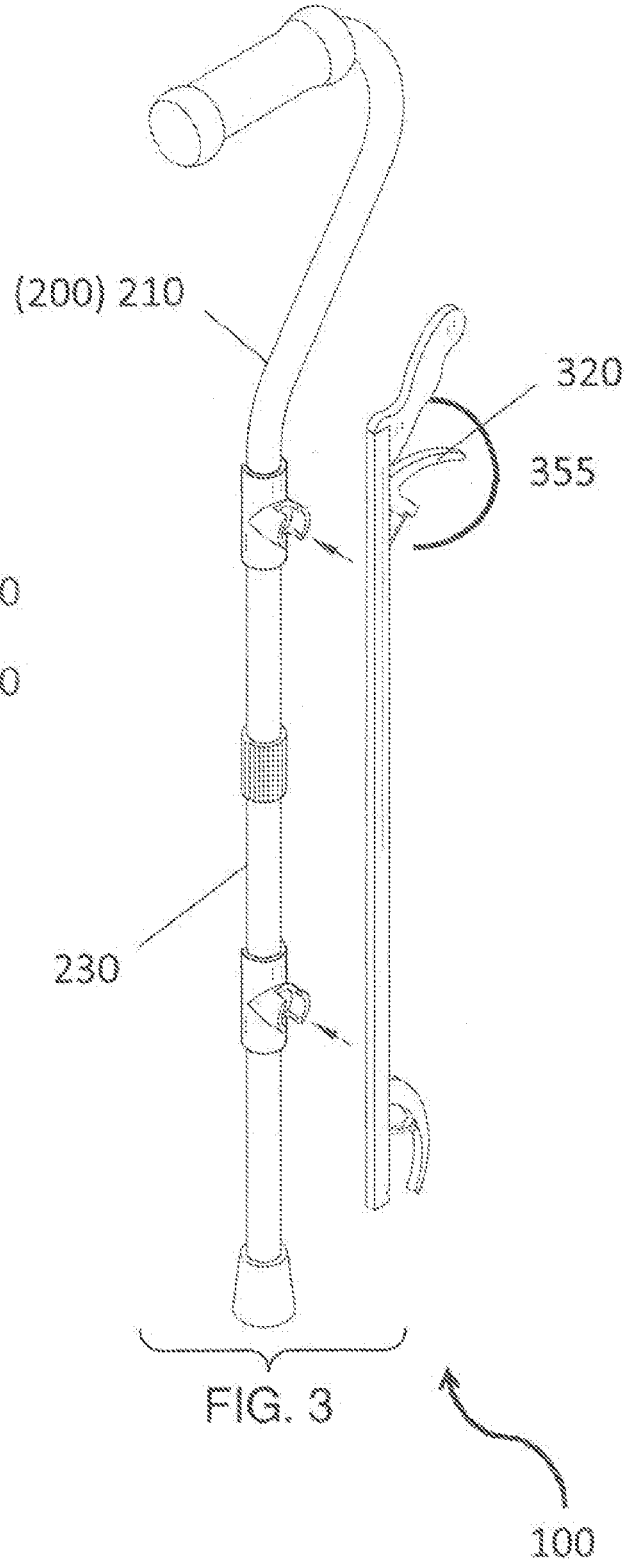
FIG. 3 is a perspective view of the system of the present invention.
Figure 4:
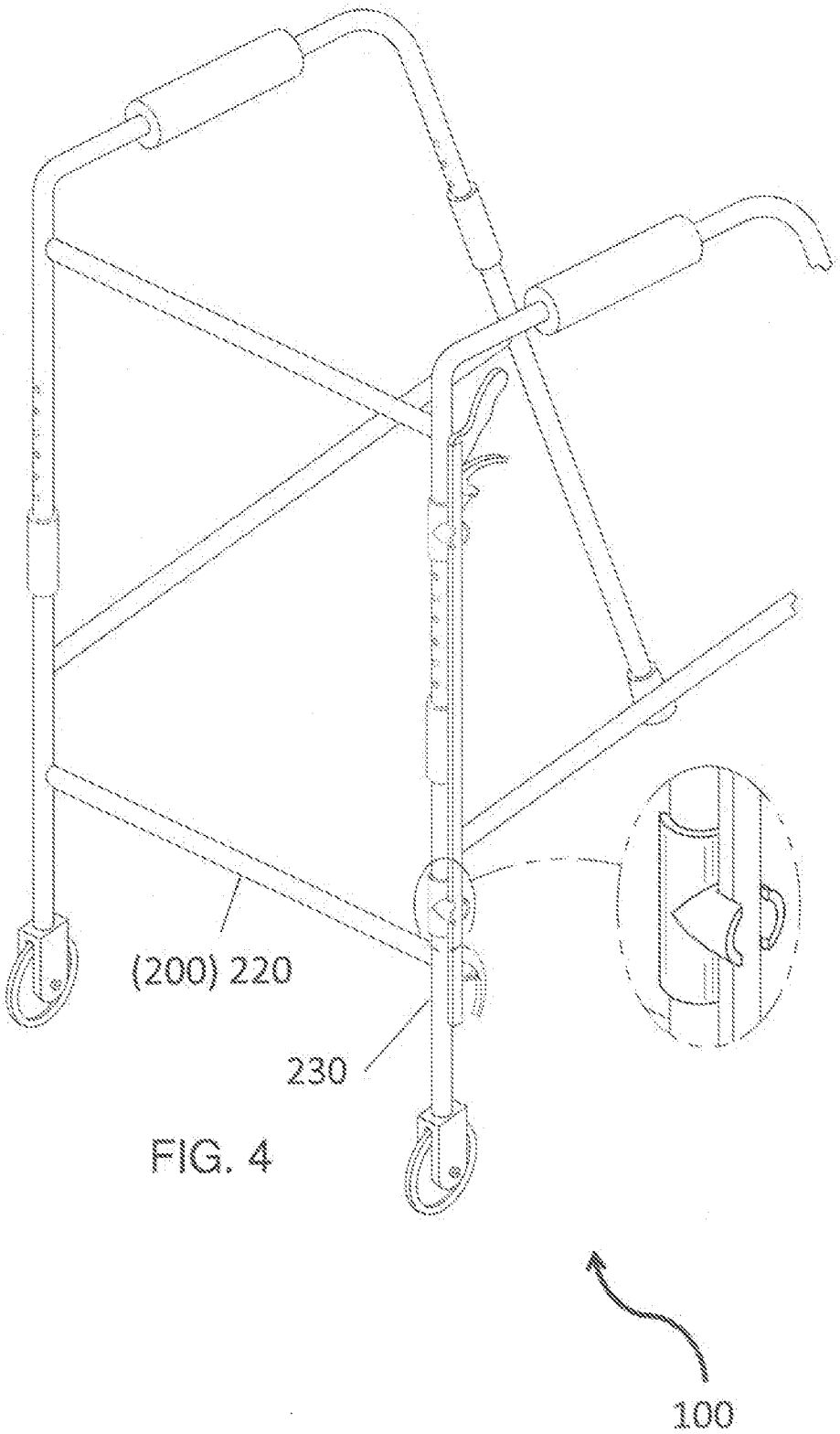
FIG. 4 is an in-use view of the system of the present invention.

Referring now to FIG. 1-4, the present invention features a mobility assistance retrieval system (100). The mobility assistance retrieval system (100) of the present invention provides a cane or walker user with a means of reaching for an object without having to put aside his/her cane or walker.

The system (100) of the present invention comprises a mobility assister (200). As used herein, a mobility assister (200) may refer to equipment that helps a user effectively walk or transport him/herself to another location. For example, in some embodiments, a mobility assister (200) comprises a cane (210). In some embodiments, a mobility assister (200) comprises a walker (220). In some embodiments, a mobility assister (200) comprises a scooter. The present invention is not limited to the aforementioned mobility assisters. Generally, the mobility assisters (200) have at least one leg shaft (230). The leg shaft (230) may be cylindrical, for example.

The system (100) of the present invention further comprises a grabber (300) for grabbing objects. The grabber (300) may be used to grab objects on the floor or objects that are out of reach, for example to help prevent the need to bend down or reach for the object. The grabber (300) comprises an elongated grabber shaft (310) having a handle end (311) and a grabbing end (312). A handle extension (350) is disposed on the handle end (311) of the grabber shaft (310). The handle extension (350) extends outwardly from the grabber shaft (310) at a first angle (355) (see FIG. 3 for illustration of the first angle). The grabber shaft (310) may be constructed in a variety of shapes and sizes. For example, in some embodiments, the grabber shaft (310) is cylindrical. In some embodiments, the grabber shaft (310) has a rectangular cross section (e.g., see FIG. 2).

A squeezable handle lever (320) is disposed on the grabber shaft (310). The squeezable handle lever (320) is L-shaped and has a vertex (323), an upper terminating end (321), and a lower terminating end (322). As shown in FIG. 1, the vertex (321) of the squeezable handle lever (320) is pivotally attached to the grabber shaft (310) below the handle extension (350). The upper terminating end (321) faces the handle extension (350), and the lower terminating end (322) faces the grabbing end (312) of the grabber shaft (310).

The squeezable handle lever (320) can pivot between at least a squeezed position and an unsqueezed position. In the squeezed position, the upper terminating end (321) of the squeezable handle lever (320) is pivoted upwardly toward the handle extension (350). In the unsqueezed position, the upper terminating end (321) of the squeezable handle lever (320) is pivoted downwardly away from the handle extension (350). The squeezable handle lever (320) is biased in the unsqueezed position.

The system (100) further comprises a grabbing arm (330) positioned at the grabbing end (312) of the grabber shaft (310). The grabbing arm (330) has a first end (331) and a second end (332). The grabbing arm (330) may be curved in shape (e.g., see FIG. 1). The first end (331) of the grabbing arm (330) is pivotally attached to the grabber shaft (310) near the grabbing end (312).

The grabbing arm (330) can pivot between at least a squeezed position and an unsqueezed position. In the squeezed position, the second end (322) of the grabbing arm (330) is pivoted to collapse toward the grabbing end (312) of the grabber shaft (310). In the unsqueezed position, the second end (322) of the grabbing arm (330) is pivoted upwardly away from the grabbing end (312) of the grabber shaft (310). The grabbing arm (330) is biased in the unsqueezed position. For example, in some embodiments, a spring is disposed between the grabbing arm and the grabber shaft (310) wherein the spring pushes the grabbing arm (330) away from the grabber shaft (310).

The system (100) further comprises a pulley component (360) and a pulley cord (370). The pulley component (360) is disposed on the grabber shaft (310) between where the first end (331) of the grabbing arm (330) pivotally attaches to the grabber shaft (310) and the grabbing end (312) of the grabber shaft (310). The pulley cord (370) has a first end (371) and a second end (372), and the first end (371) is attached to the lower terminating end (322) of the squeezable handle lever (320). The pulley cord (370) extends downwardly toward the pulley component (360) and wraps at least partially around the pulley component (360). The second end (372) of the pulley cord (370) is attached to the grabbing arm (330) at a point in between the first end (331) and the second end (332) of the grabbing arm (330) (see FIG. 1).

When the squeezable handle lever (320) is pivoted to the squeezed position, the pulley cord (370) is pulled toward the handle end (311) of the grabber shaft (310). This subsequently causes the grabbing arm (330) to pivot to the squeezed position so as to (in combination with the grabbing end (312) of the grabber shaft (310)) effectively grab an object.

The system (100) further comprises one or more clip components (400) for temporarily securing the grabber (300) to the leg shaft (230) of the mobility assister (200). The grabber (300) can be attached to or removed from the leg shaft (230) via the clip components (400), e.g., a first clip component (400*a*), a second clip component (400*b*), etc. When the grabber (300) is removed from the leg shaft (230), a user can use the grabber (300) to grab an object.

The clip components (e.g., the first clip component 400*a*, the second clip component 400*b*) comprise a first acceptance port (410) and a second acceptance port (420) opposite the first acceptance port (410). The first acceptance port (410) is attachable to the leg shaft (230) of the mobility assister (200), and the second acceptance port (420) can temporarily attach to the grabber shaft (310) of the grabber (300).

The acceptance ports may be constructed in a variety of shapes to accommodate the shapes of the leg shaft (230) of the mobility assister (200) and the grabber shaft (310). For example, in some embodiments, the first acceptance port (410) is half-pipe in shape. In some embodiments, the clip components (400) have a structure of a T-pipe connector (as viewed from the side), wherein a cutout is in the top portion of the T to accommodate the leg shaft (230) and cutouts are disposed in the stem of the T for accommodating the grabber shaft (310).

In some embodiments, the second acceptance port (420) comprises a hollow cylindrical component (428) having a first end (421) attached to the first acceptance port (410) and an open second end (422). The axis of the cylindrical component (428) is oriented perpendicular to that of the leg shaft (230) of the mobility assister (200) (and the axis of the first acceptance port). A pair of cutouts (440) is disposed in the second end (422) of the cylindrical component (428) positioned parallel to one another. The cutouts (440) are adapted to accept the grabber shaft (310). The cutouts (440) are positioned to allow the grabber shaft (310) to be parallel to the leg shaft (230) of the mobility assister (200).

In some embodiments, the first acceptance port (410) of the clip component (410) has a height greater than that of the second acceptance port (420).

As used herein, the term "about" refers to plus or minus 10% of the referenced number.

The disclosures of the following U.S. Patents are incorporated in their entirety by reference herein: U.S. Pat. No. 3,763,872; U.S. Pat. No. 5,392,800; U.S. Pat. No. 5,433,234; U.S. Pat. No. 6,951,224; U.S. Design Pat. No. D620,696; U.S. Pat. Application No. 2009/0032077.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A mobility assistance retrieval system (100) for retrieving objects, said system (100) comprising:

(a) a mobility assister (200) having at least one leg shaft (230);

(b) a grabber (300) adapted to temporarily grip objects, the grabber (300) comprises:

(i) an elongated grabber shaft (310) having a handle end (311) and a grabbing end (312), (ii) a handle extension (350) disposed on the handle end (311) of the grabber shaft (310) and extending outwardly from the grabber shaft (310) at a first angle (355), (iii) a squeezable handle lever (320), the squeezable handle lever (320) is L-shaped with a vertex (323), an upper terminating end (321) and a lower terminating end (322), the vertex (321) of the squeezable handle lever (320) is pivotally attached to the grabber shaft (310) below the handle extension (350), the upper terminating end (321) faces the handle extension (350) and the lower terminating end (322) faces the grabbing end (312) of the grabber shaft (310), the squeezable handle lever (320) can pivot between at least a squeezed position wherein the upper terminating end (321) of the squeezable handle lever (320) is pivoted upwardly toward the handle extension (350) and an unsqueezed position wherein the upper terminating end (321) of the squeezable handle lever (320) is pivoted downwardly away from the handle extension (350), the squeezable handle lever (320) is biased in the unsqueezed position, (iv) a grabbing arm (330), the grabbing arm (330) has a first end (331) and a second end (332), the first end (331) of the grabbing arm (330) is pivotally attached to the grabber shaft (310) near the grabbing end (312), the grabbing arm (330) can pivot between at least a squeezed position wherein the second end (322) of the grabbing arm (330) is pivoted to collapse toward the grabbing end (312) of the grabber shaft (310) and an unsqueezed position wherein the second end (322) of the grabbing arm (330) is pivoted upwardly away from the grabbing end (312) of the grabber shaft (310), the grabbing arm (330) is biased in the unsqueezed position, (v) a pulley component (360) disposed on the grabber shaft (310) in between where the first end (331) of the grabbing arm (330) pivotally attaches to the grabber shaft (310) and the grabbing end (312) of the grabber shaft (310), and (vi) a pulley cord (370) having a first end (371) and a second end (372), the first end (371) is attached to the lower terminating end (322) of the squeezable handle lever (320), the pulley cord (370) extends downwardly toward the pulley component (360) and wraps at least partially around the pulley component (360), the second end (372) of the pulley cord (370) is attached to the grabbing arm (330) at a point in between the first end (331) and the second end (332) of the grabbing arm (330), when the squeezable handle lever (320) is pivoted to the squeezed position the pulley cord (370) is pulled toward the handle end (311) of the grabber shaft (310) subsequently causing the grabbing arm (330) to pivot to the squeezed position so as to in combination with the grabbing end (312) of the grabber shaft (310) effectively grab an object; and (c) at least a first clip component (400*a*) adapted to temporarily secure the grabber (300) to the leg shaft (230) of the mobility assister (200), the first clip component (400*a*) comprises a first acceptance port (410) and a second acceptance port (420) opposite the first acceptance port (410), the first acceptance port (410) is attached to the leg shaft (230) of the mobility assister (200) and the second acceptance port (420) temporarily attaches to the grabber shaft (310) of the grabber (300);

wherein the grabber (300) can be attached to or removed from the leg shaft (230) via the first clip component (400*a*), when the grabber (300) is removed from the leg shaft (230) a user can use the grabber (300) to grab an object.

2. The system (100) of claim 1, wherein the mobility assister (200) comprises a walker (220).

3. The system (100) of claim 1, wherein the mobility assister (200) comprises a cane (210).

4. The system (100) of claim 1, wherein the leg shaft (230) of the mobility assister (200) is cylindrical.

5. The system (100) of claim 1, wherein the grabber shaft (310) of the grabber (300) has a rectangular cross-section.

6. The system (100) of claim 1, wherein the first acceptance port (410) of the clip component (410) is half-pipe in shape.

7. The system (100) of claim 1, wherein the first acceptance port (410) of the clip component (410) has a height greater than that of the second acceptance port (420).

8. The system (100) of claim 1, wherein the second acceptance port (420) comprises a hollow cylindrical component (428) having a first end (421) attached to the first acceptance port (410) and an open second end (422), an axis of the cylindrical component (428) is oriented perpendicular to that of the leg shaft (230) of the mobility assister (200), a pair of cutouts (440) is disposed in the second end (422) of the cylindrical component (428) positioned parallel to one another, the cutouts (440) are adapted to accept the grabber shaft (310), the cutouts (440) are positioned to allow the grabber shaft (310) to be parallel to the leg shaft (230) of the mobility assister (200).

9. The system (100) of claim 1 further comprising a second clip component (400*b*) adapted to temporarily secure the grabber (300) to the leg shaft (230) of the mobility assister (200), the second clip component (400*b*) comprises a first acceptance port (410) and a second acceptance port (420) opposite the first acceptance port (410), the first acceptance port (410) is attached to the leg shaft (230) of the mobility assister (200) and the second acceptance port (420) temporarily attaches to the grabber shaft (310) of the grabber (300).

10. A mobility assistance retrieval system (100) for retrieving objects, said system (100) consisting of:

(a) a mobility assister (200) having at least one leg shaft (230);

(b) a grabber (300) adapted to temporarily grip objects, the grabber (300) consists of:

(i) an elongated grabber shaft (310) having a handle end (311) and a grabbing end (312), (ii) a handle extension (350) disposed on the handle end (311) of the grabber shaft (310) and extending outwardly from the grabber shaft (310) at a first angle (355), (iii) a squeezable handle lever (320), the squeezable handle lever (320) is L-shaped with a vertex (323), an upper terminating end (321) and a lower terminating end (322), the vertex (321) of the squeezable handle lever (320) is pivotally attached to the grabber shaft (310) below the handle extension (350), the upper terminating end (321) faces the handle extension (350) and the lower terminating end (322) faces the grabbing end (312) of the grabber shaft (310), the squeezable handle lever (320) can pivot between at least a squeezed position wherein the upper terminating end (321) of the squeezable handle lever (320) is pivoted upwardly toward the handle extension (350) and an unsqueezed position wherein the upper terminating end (321) of the squeezable handle lever (320) is pivoted downwardly away from the handle extension (350), the squeezable handle lever (320) is biased in the unsqueezed position, (iv) a grabbing arm (330), the grabbing arm (330) has a first end (331) and a second end (332), the first end (331) of the grabbing arm (330) is pivotally attached to the grabber shaft (310) near the grabbing end (312), the grabbing arm (330) can pivot between at least a squeezed position wherein the second end (322) of the grabbing arm (330) is pivoted to collapse toward the grabbing end (312) of the grabber shaft (310) and an unsqueezed position wherein the second end (322) of the grabbing arm (330) is pivoted upwardly away from the grabbing end (312) of the grabber shaft (310), the grabbing arm (330) is biased in the unsqueezed position, (v) a pulley component (360) disposed on the grabber shaft (310) in between where the first end (331) of the grabbing arm (330) pivotally attaches to the grabber shaft (310) and the grabbing end (312) of the grabber shaft (310), and (vi) a pulley cord (370) having a first end (371) and a second end (372), the first end (371) is attached to the lower terminating end (322) of the squeezable handle lever (320), the pulley cord (370) extends downwardly toward the pulley component (360) and wraps at least partially around the pulley component (360), the second end (372) of the pulley cord (370) is attached to the grabbing arm (330) at a point in between the first end (331) and the second end (332) of the grabbing arm (330), when the squeezable handle lever (320) is pivoted to the squeezed position the pulley cord (370) is pulled toward the handle end (311) of the grabber shaft (310) subsequently causing the grabbing arm (330) to pivot to the squeezed position so as to in combination with the grabbing end (312) of the grabber shaft (310) effectively grab an object; and (c) at least a first clip component (400*a*) adapted to temporarily secure the grabber (300) to the leg shaft (230) of the mobility assister (200), the first clip component (400*a*) consists of a first acceptance port (410) and a second acceptance port (420) opposite the first acceptance port (410), the first acceptance port (410) is attached to the leg shaft (230) of the mobility assister (200) and the second acceptance port (420) temporarily attaches to the grabber shaft (310) of the grabber (300);

wherein the grabber (300) can be attached to or removed from the leg shaft (230) via the first clip component (400*a*), when the grabber (300) is removed from the leg shaft (230) a user can use the grabber (300) to grab an object.

* * * * *